United States Patent [19]

Kim

[11] Patent Number: 5,010,223

[45] Date of Patent: Apr. 23, 1991

[54] OUTPUT CONTROL CIRCUIT OF A 4-BURNER ELECTRONICS INDUCTION HEATING COOK SYSTEM AND A CONTROL METHOD THEREOF

[75] Inventor: Jeong Y. Kim, Seoul, Rep. of Korea

[73] Assignee: Sang Wook Suh International, Seoul, Rep. of Korea

[21] Appl. No.: 358,809

[22] Filed: May 31, 1989

[30] Foreign Application Priority Data

May 31, 1988 [KR] Rep. of Korea ..... 6536/88

[51] Int. Cl.[5] ..... H05B 6/08

[52] U.S. Cl. ..... 219/10.77; 219/10.41; 219/10.493; 363/97; 363/131; 323/902

[58] Field of Search ..... 219/10.77, 10.493, 10.41, 219/10.71; 363/97, 98, 131, 132; 323/902

[56] References Cited

U.S. PATENT DOCUMENTS

| | | | |
|---|---|---|---|
| 4,223,195 | 9/1980 | Bechtel | 219/10.55 B |
| 4,453,068 | 6/1984 | Tucker et al. | 219/10.77 |
| 4,467,184 | 8/1984 | Loessel | 219/506 |

FOREIGN PATENT DOCUMENTS

| | | |
|---|---|---|
| 56-130536 | 10/1981 | Japan . |
| 59-11417 | 1/1984 | Japan . |
| 59-109723 | 6/1984 | Japan . |
| 60-150101 | 8/1985 | Japan . |
| 60-193025 | 10/1985 | Japan . |
| 60-229102 | 11/1985 | Japan . |
| 60-229105 | 11/1985 | Japan . |
| 60-229123 | 11/1985 | Japan . |

*Primary Examiner*—Philip H. Leung

*Attorney, Agent, or Firm*—Sterne, Kessler, Goldstein, & Fox

[57] ABSTRACT

An output control circuit of a 4-burner electronics induction heating cook system comprises a unit for measuring the proportional setting time to selectively operate the timing on-off control and the frequency control of a heating load; an invertor circuit for generating a proportional time and applying this to the load; a current feedback/output adjusting circuit provided with a differential amplifier inputing a high or low level signal according to a signal from the current detector; an output setting control portion provided with a unit for comparing the signals from the circuit connected to the adjusting circuit and the saw tooth wave generating circuit and then outputing a pulse width modulation signal; an output setting control portion provided with at least one photocoupler wired in an OR configuration to control the operation of the control portion and a microprocessor connected to control the operation of the photocouplers; a base operating portion and a timing circuit for controlling an invertor circuit, thereby preventing current surges generated by the maximum outputing step and for preventing noise caused by the mutual interference field generated between plural heating areas at the minimum output step.

3 Claims, 6 Drawing Sheets

FIG. 6

| STEP NUMBER OF THE SELECTION KEY | A2 | A1 | A0 | a5 | a4 | a3 | a2 | a1 | a0 | |
|---|---|---|---|---|---|---|---|---|---|---|
| 0 | Ø | Ø | Ø | 1 | 1 | 1 | 1 | 1 | 1 | BEFORE THE SELECTING OF THE KEY |
| 1 | Ø | Ø | 1(Ø) | 1 | 1 | 1 | 1 | Ø(1) | 1(Ø) | AØ TIME ON-OFF CONTROL ↓ a1, a2 ARE ON AND OFF IN TURNS BY BEING SET AT 1 OR 0 |
| 2 | Ø | Ø | 1(Ø) | 1 | 1 | 1 | 1 | Ø(1) | 1(Ø) | |
| 3 | Ø | Ø | 1(Ø) | 1 | 1 | 1 | 1 | Ø(1) | 1(Ø) | |
| 4 | Ø | Ø | 1(Ø) | 1 | 1 | 1 | 1 | Ø(1) | 1(Ø) | |
| 5 | Ø | Ø | 1(Ø) | 1 | 1 | 1 | 1 | Ø(1) | 1(Ø) | |
| 6 | Ø | Ø | 1(Ø) | 1 | 1 | 1 | 1 | Ø | 1 | |
| 7 | Ø | 1 | Ø | 1 | 1 | 1 | Ø | 1 | 1 | a2 = Ø SET |
| 8 | Ø | 1 | 1 | 1 | 1 | Ø | 1 | 1 | 1 | a3 = Ø SET |
| 9 | 1 | Ø | Ø | 1 | Ø | 1 | 1 | 1 | 1 | a4 = Ø SET |
| 10 | 1 | Ø | 1 | Ø | 1 | 1 | 1 | 1 | 1 | a5 = Ø SET |

OUTPUT CONTROL CIRCUIT OF A 4-BURNER ELECTRONICS INDUCTION HEATING COOK SYSTEM AND A CONTROL METHOD THEREOF

BACKGROUND OF THE INVENTION

The present invention is related to providing an induction heating cooker, and particularly to providing a 4-burner electronics induction heating cook system for controlling the output according to the control input signal for operating the cooker.

The control circuit of a conventional electronics induction heating cooker includes two types of controlling the calorie amount of the cooker, for example, a timing on-off control manner and a frequency control manner.

The typical example of the timing on-off control manner is disclosed in U.S. Pat. No. 4453068 issued to Mr. Raymond M. Tucker, et al. entitled "Induction Cook-top System and Control."

An induction heating system 40 is provided, which includes a plurality of induction heating coils 118. Touch control pads are provided together with circuitry 80 for generating energizing control signals. Circuitry 80 is provided for electrically energizing the induction heating coils 118. An electronic digital processor 82 is responsive to the energizing control signals for generating energizing signals for actuating and controlling the energizing circuitry 112, 116 to thereby vary the energizing of the plurality of induction heating coils.

Similarly, the circuit is provided with a timer used as a temperature controller, a zero crossing detector, a differential amplifier, a ramp generator and an output generator. The differential amplifier includes temperature setting means and the temperature sensing means (for example thermistor) to execute the on-off switching operation of the load. The ramp generator is provided with a delaying circuit having a predetermined time so that it receives the signals having a duration of timing corresponding to the on-off switching operation of the differential amplifier to adjust the timing. The output amplifier is provided with a triac, the triggering of which corresponds to the zero crossing of the A.C. voltage source to repeatedly generate a saw-shaped wave and to induce the operation of the load, for example, a heating device, etc.

Thus, the output having the on-off time predetermined by the ramp generator controls the load by the synchronized on-off switching means and the triac of the zero voltage switch, which is connected to the differential amplifier and selected according to the temperature control requirement. Hence, it is known that the heating cooker presets the maximum heating output and controls the on-off timing of the output.

If the conventional cooker includes more than one high frequency heating device, a surge current applied by adjacent heating burners can overload a burner when operated over 1000W of the maximum heating output. The induction cook-top system disclosed in U.S. Pat. No. 4,453,068 varies the energizing of the plurality of induction coils, but was not shown relative control of the maximum output, and thus, suffers from surge currents as described above.

Also, conventional frequency control manners include a temperature frequency converter to generate the frequency converting output in response to the temperature change and change the output voltage relative to the load.

Multi-burner cookers experience inter-burner interference because adjacent burners are allowed to operate at different frequencies, and thus, interfere with each other or even influence adjacent electrical appliance to generate interference noise.

SUMMARY OF THE INVENTION

Accordingly, the main object of the present invention is to provide an electronics induction heating cook system having a composite function of an on-off control manner and a frequency control manner to resolve the above problems; in which said system is adapted to the on-off timing control manner at a relatively lower output and the frequency control manner at a relatively higher output.

Another object of the present invention is to provide a method for controlling an electronics induction heating cook system to perform the on-off timing operation at relatively lower power and the frequency operation at a relatively higher power.

Thus, the present invention comprises:

a current transformer for detecting the current of a power source;

a rectifying means for rectifying the current of the power source;

an inverting means for generating a voltage proportional to the frequency or to the voltage according to lapsed time and applying this voltage to a heating coil of the burner;

a current feedback/output adjusting circuit provided with a differential amplifier for receiving the detecting current from the transformer, thereby outputting the low level over the predetermined value and the high level below the predetermined value;

an output control portion provided with a comparator, the inverting terminal and the non-inverting terminal of which are connected to an output terminal of the amplifier and the saw tooth wave generating circuit, respectively, thereby comparing the inputting signals from its terminals and generating a pulse width modulation signal;

an outputting control setting portion including at least one set of parallel coupled photocouplers, wired in a logical OR configuration to at least one output terminals of the decoder via diodes, and a microprocessor for generating the predetermined output according to the output selecting key, to which the decoder is connected;

a base operating portion connected to the output control portion for controlling the operation of the invertor according to the output thereof;

a timing circuit connected to the output control portion for generating the pulse having the predetermined time constant; and a saw tooth wave generating circuit for generating a saw tooth wave corresponding to the pulse cycle of the timing circuit.

Also, the method of the present invention comprises the steps for determining the input of the decoder according to the input of the output selecting key and performing the frequency control operation at over the predetermined value of the current adjusting of the current detector.

Therefore, the present invention has enhanced reliability based on the fact that it performs the on-off timing control to restrain the generation of the surge current during the operation of the maximum output, as well as frequency control during operation to decrease the noise caused by mutual interference fields between heating areas.

BRIEF DESCRIPTION OF DRAWINGS

The above and other objects of the present invention will be seen by the following description taken in connection with the accompanying drawings, in which;

FIG. 6 is a truth table according to the operation of the output control setting portion of the present invention.

DETAIL DESCRIPTION OF THE INVENTION

Figure 1:
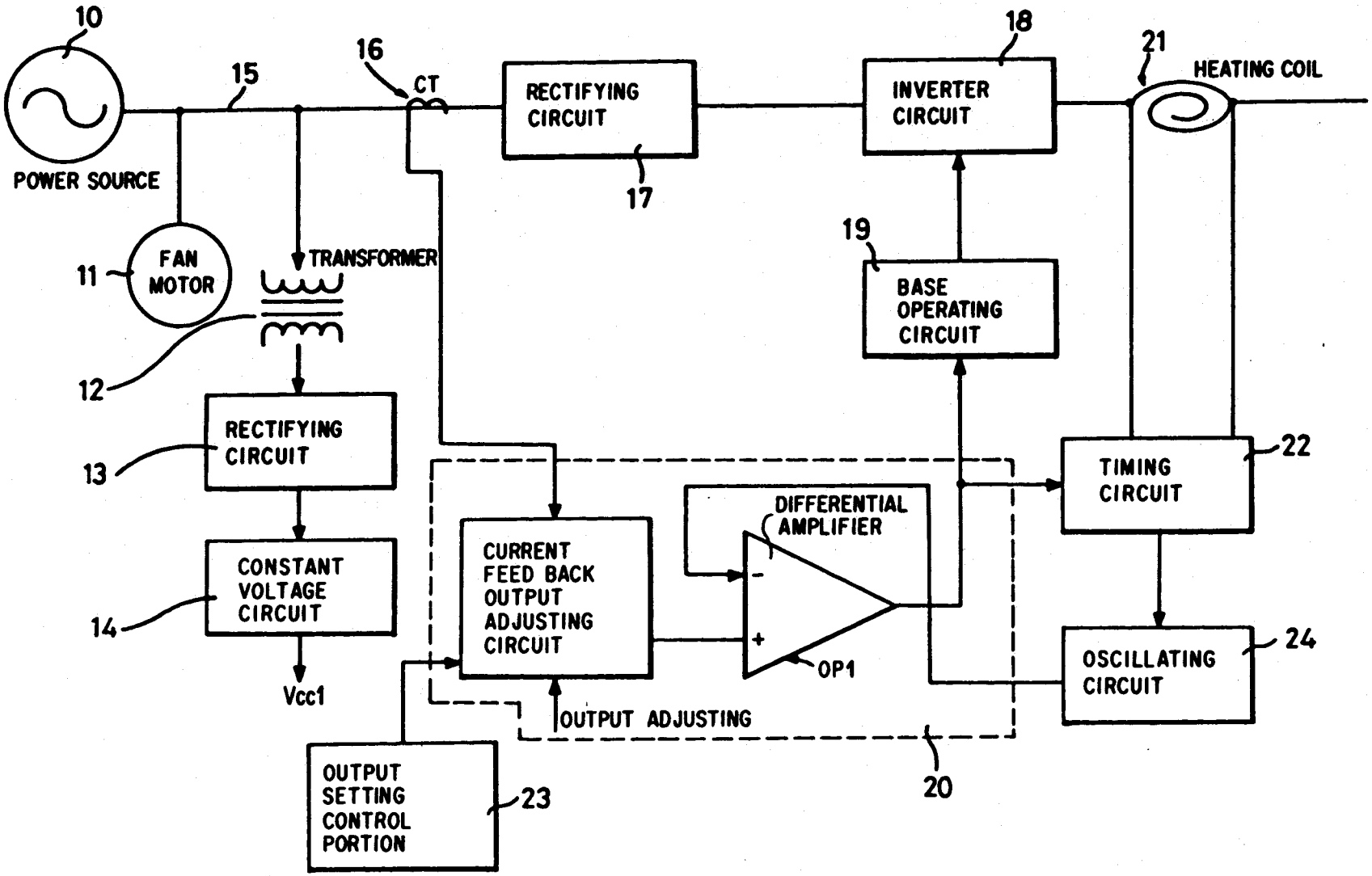
FIG. 1 is a block diagram of the output control circuit constructed according to the principle of the present invention.

FIG. 1 is a schematic block diagram of the output control circuit in a 4-burner electronics induction heating cook system according to the present invention.

In the drawings, power source 10 is directly applied to fan motor 11 and transformer 12. Transformer 12 is a power source of the output control circuit as described below, in which rectifying circuit 13 is connected to constant voltage circuit 14 to generate the constant voltage Vcc1. Power source line 15 directed to power source 10 is connected to current transformer 16 for detecting the minor current. The detecting current of current transformer 16 is supplied to output control portion 20 as described below.

Other rectifying circuit 17 is connected to adjacent current transformer 16 so that the source thereof is supplied to invertor circuit 18 provided with the power amplifier.

Invertor circuit 18 receives the operation signal of base operation circuit 19 and applies the power source to heating coil 21 according to the receiving signal. Output control portion 20 outputs the timing on-off signal or the frequency width modulation signal to base operation circuit 19 responsive to the setting input from output setting control portion 23 connected thereto.

Also, the signal of output control portion 20 is applied to timing circuit 22, so that timing circuit 22 controls the operation of heating coil 21 connected thereto as well as to oscillating circuit 24, so that oscillating circuit 24 is applied to output control portion 20 to generate the pulse width modulation signal.

Figure 2:
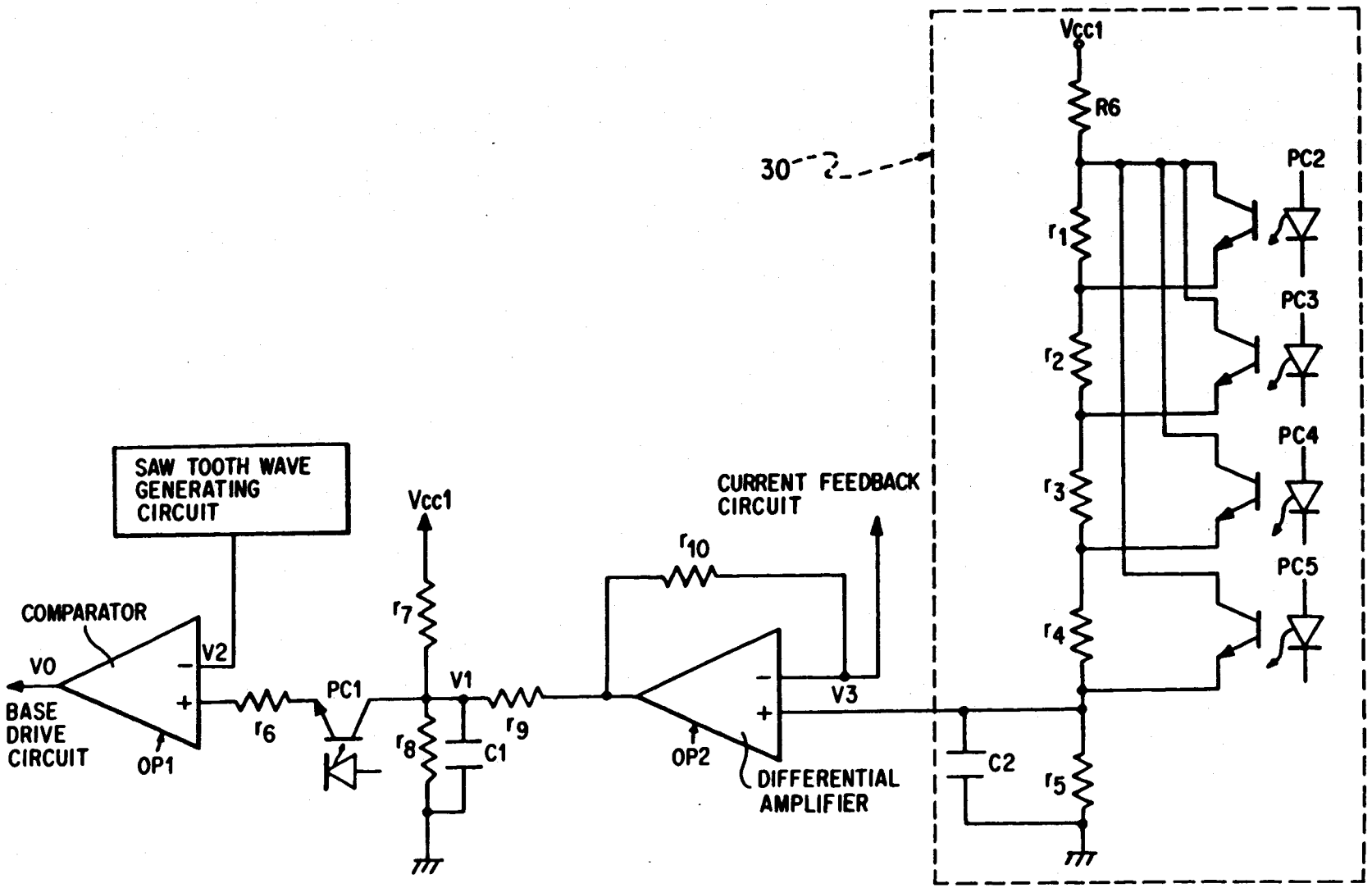
FIG. 2 is a detail circuit of the output control portion constructed according to the principle of the present invention.

FIG. 2 is shows the detail circuit of the output control portion 20 according to the principle of the present invention.

Output control portion 20 is provided with differential amplifier OP2 and comparator OP1. Differential amplifier OP2 has the inverting terminal (indicated by the "−" sign) which is connected to current transformer 16 and fed back through resistor r10 to the output terminal. Also, the non-inverting terminal thereof (indicated by the "+" sign) is connected to output setting control portion 30, in which at least one set of photocouplers PC2–PC5 is connected in parallel through voltage dividing resistor r1–r4 to each other.

The collectors of photocouplers PC2–PC5 are connected in common to the other at one end of resistor R6, the emitter of photocoupler PC2 is connected to the other end of voltage dividing resistor r1 having one end of which is connected to resistor R6. Similarly, each emitter of photocouplers PC3–PC5 is respectively connected to the other end of resistors r2–r4, respectively. Also, the non-inverting terminal of differential amplifier OP2 has ripple removing condenser C2 and voltage dividing resistor r5 connected in parallel to each other. Thus, the current limiting/output adjusting circuit is constructed.

Accordingly, differential amplifier OP2 receives the voltage V3 at the non-inverting terminal which is represented as the following expression; the values of resistors R6, r2, r3, r4 and r5 are summed, the value of resistor r5 is divided by this total value, and then multiplied by voltage Vcc1 when photocoupler PC2 is operated. Similarly, differential amplifier OP2 receives the voltage V3 at the non-inverting terminal which is represented as the following expression; the values of resistors R6, r3, r4 and r5 are summed, the value of resistor r5 is divided by the summed value and multiplied by voltage Vcc1 when photocoupler PC3 is operated.

The output of differential amplifier OP2 is applied through resistor r9, photocoupler PC1 and resistor r6 to the non-inverting terminal of comparator OP1. This comparator OP1 is provided with the saw tooth wave oscillating circuit 24 to be constructed as the pulse width modulation circuit.

On the other hand, to the middle tap between photocoupler PC1 and resistor r9 there are connected the circuit for generating the on-off timing signals if the output of differential amplifier OP2 is at a low level, in which serially connected voltage dividing resistors r7 and r8 are connected to power source Vcc1. Therefore, voltage V1 of the middle tap is determined as the predetermined value by voltage dividing resistors r7 and r8. Voltage V2 applied to the non-inverting terminal of comparator OP1 is determined by saw tooth wave generating circuit 24.

The output of comparator OP1 is applied to base operating circuit 19 and timing circuit 22, so that the operation of heating coil 21 is performed. Timing circuit 22 forces heating coil 21 to be on or off, and applies a pulse having the predetermined timing constant to oscillating circuit 24.

Figure 3:
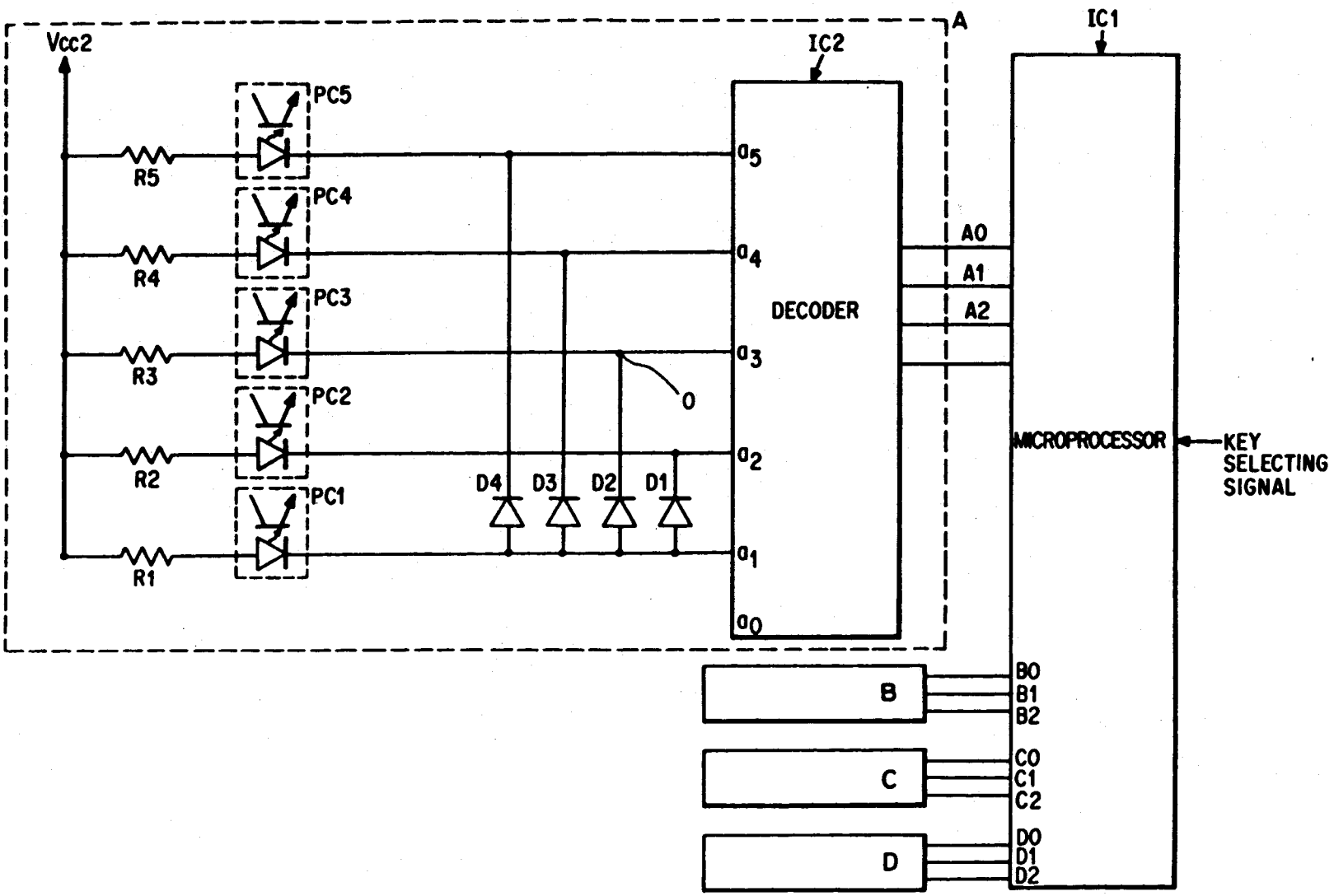
FIG. 3 is a detail circuit of the output setting control portion constructed according to the principle of the present invention.

FIG. 3 shows output setting control portion 23 constructed according to the principle of the present invention.

Output setting control portion 23 is provided with microprocessor IC1 for setting the outputs of at least one heating burner A, B, C and D. Microprocessor IC1 receives the selecting signal from the output selecting keys. At its output terminals A0–A2, the output setting signal relative to burner A is generated, for example. Similarly, at its output terminals B0–B2, C0–C2 and D0–D2, the output setting signals relative to each of burners B, C and D are generated, respectively.

Figure 4:
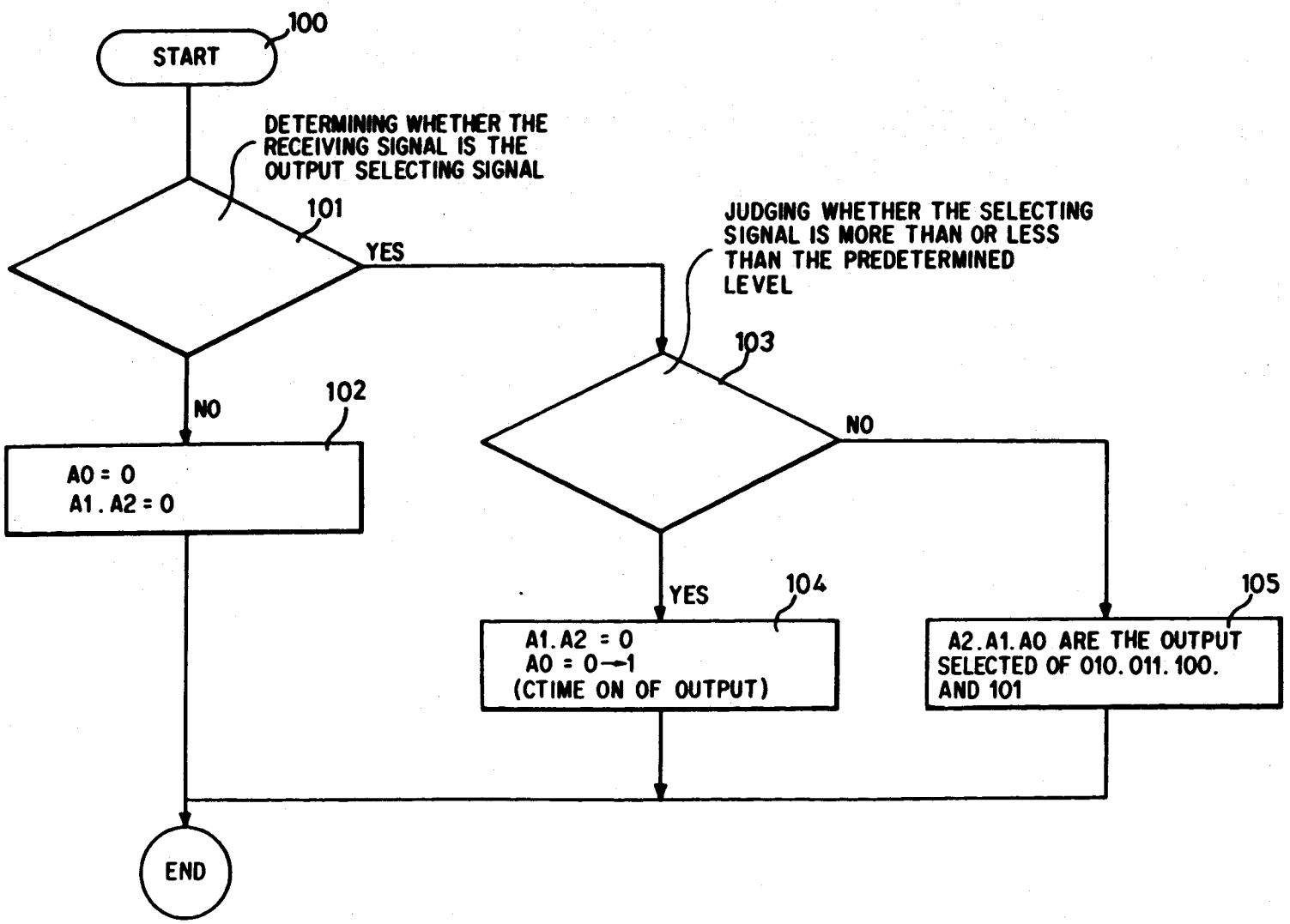
FIG. 4 is a flow chart representing the operation according to the principle of the present invention.

That is to say, as shown at the flow chart of FIG. 4, if the selecting signal from the output selecting key is input, at step 101 microprocessor IC1 judges whether the receiving signal is the output selecting signal. If the receiving signal is not the output selecting key, microprocessor IC1 goes on to step 102 and outputs the low level signal of A0, A1, A2=0 from its output terminal.

At step 103, microprocessor IC1 judges whether the selecting signal is more or less than the predetermined setting level. Assuming that the setting level is the output level according to the step number of the selecting key in FIG. 5, if the setting level is below step 6, output terminals A1, A2 output a level 0 and output terminal A0 outputs level 0 to 1 at step 104. If the setting level is under step 6, output terminals A2, A1, and A0 respectively generate 0, 1, 0 at step 7 ; 0, 1, 1 at step 8 ; 1, 0, 0 at step 9 and 1, 0, 1 at step 10.

Referring to FIG. 3 again, the outputs of microprocessor IC1 are connected to decoder IC2 for outputting the selecting signal according to the setting level. This decoder IC2 generates the output as shown in FIG. 6 at its output terminals a0 to a5. Herein, it is known that the output terminal a0 is under a floating condition. Photodiode of photocoupler PC1 and resistor R1 are connected in series to output terminal a1, the photodiode of photocoupler PC2 and resistor R2 are connected in series to output terminal a2, the photodiode of photocoupler PC3 and resistor R3 are connected in series to output terminal a3, the photodiode of photocoupler PC4 and resistor R4 are connected in series to output terminal a4, and the photodiode of photocoupler PC5 and resistor R5 are connected in series to output terminal a5. Also, diodes D1 to D4 have their anodes connected between the photodiode of photocoupler PC1 and output terminal a1 and have their cathodes connected in a logical "OR" configuration to output terminals a2, a3, a4 and a5, respectively.

The present invention is operated as the follows. Microprocessor IC1 outputs the setting signal from its output terminals under the reset condition according to the selecting signal from the output selecting key to operate burner A. For example, if the relative lower output (step 1 to 6 of FIG. 6) is selected in connection with burner A, only output terminal A0 outputs the high and low level signals in turn at a constant period. Decoder IC2 outputs the high and low level signal in turn from output terminal a1 and the high level signal from the other output terminal a2 to a5. Therefore, the photodiodes of photocouplers PC2-PC5 are not operated, and only the photodiode of photocoupler PC1 is turn on-off to force the phototransistor to be saturated (periodically cut-off). Thus, voltage V3 applied to differential amplifier OP2 from output control portion 20 is represented as Vcc1* r5/R6+r2+r3+r4+r5 by voltage dividing resistor R6, r2 to r5.

This voltage is applied to differential amplifier OP2 along with the voltage of current transformer 16. Differential amplifier OP2 outputs the low level signal if voltage V3 is lower than that of current transformer 16 and the high level signal if voltage V3 is higher than that of current transformer 16, but at this time differential amplifier OP2 outputs the low level signal. Thus, voltage V1 allows the current of condenser C1 to be discharged, resulting in a voltage V1, corresponding to voltage V1 as shown at GA in FIG. 5A, intermittently applied to the non-inverting terminal of comparator OP1 according to the intermittent operation of photocoupler PC1.

Figure 5A:
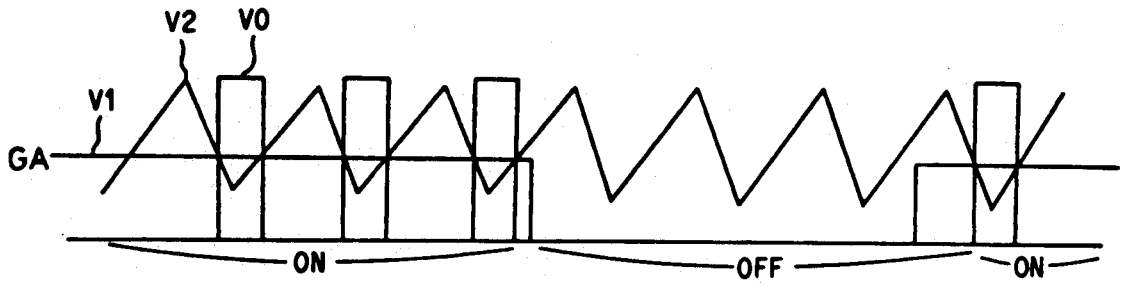
FIGS. 5A, 5B and 5C are wave-form views according to the operation of the output control portion of the present invention.
Figure 5B:
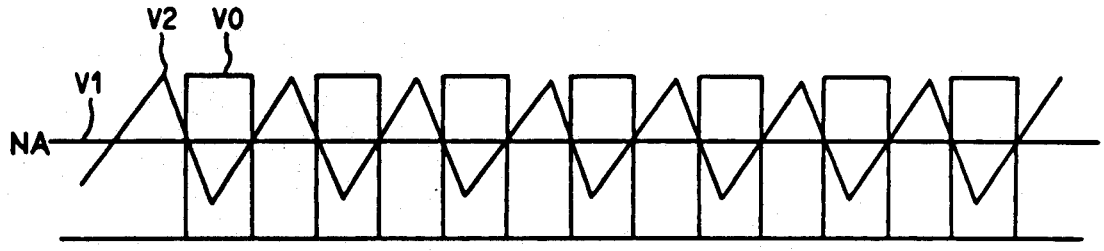

Comparator OP1 receives voltage V2 of the saw tooth wave, (see voltage V2 as shown in FIG. 5A), from its non-inverting terminal thereby to output voltage V3. As a result, at the on-period of voltage V1, the constant output is applied to comparator 16 to output voltage V0, so that voltage V0 is applied to base operating circuit 19 to operate invertor 18 and heating coil 21. Also, the operation of heating coil 21 is stopped at the off-period of voltage V1. As described above, the timing on-off control is performed at a relatively lower output. Thus, the on-off cycle of voltage V1 is periodically controlled by microprocessor IC1 and decoder IC2.

At relatively higher outputs, any one of the outputs of microprocessor IC1 is controlled to be set at the low level. For example, if the selecting key of step 8 is selected, each of output terminals A2, A1 and A0 outputs a low level signal, the high level signal and the high level signal, respectively, to force decoder IC2 to output the low level signal only at output terminal a3 and the high level signal at the remaining terminals, so that the photodiode of photocouplers PC3 and PC1 are turned on by resistor R1 and diode D2, for diode D2 is connected in a logical OR configuration as shown at connection point 0.

In this case, voltage V3 at the output control portion 20 is the voltage divided by the value of resistors r2, r3, r4 and r5, and thus, increases more than that at the low output. This voltage forces differential amplifier OP2 to output the high level signal. This high level signal is applied through photocoupler PC1 to comparator OP1. Comparator OP1 compares the high signal with the saw tooth applied to the inverting terminal thereof, thereby outputting the signal of voltage V0 (referring to the wave form of FIG. 5B ). Herein, it is noted that the frequency of voltage V0 is fixed at the constant frequency.

Figure 5C:
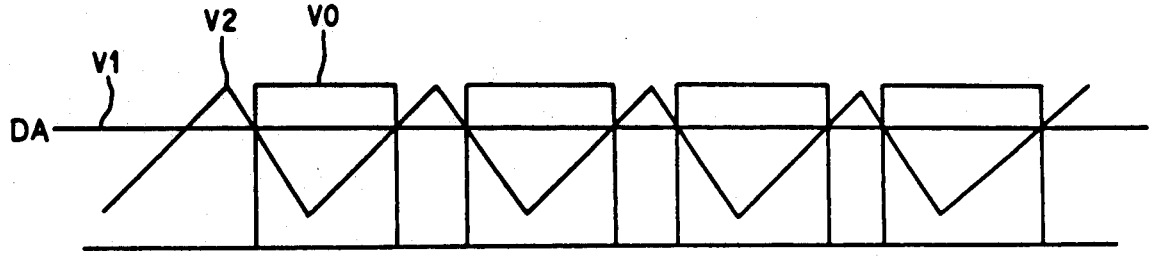

Also, if an output higher than step 8 is selected, voltage V1 is increased, the period of voltage V2 is extended, and comparator OP1 outputs voltage V0 having the constant frequency, such like the wave form of FIG. 5C, to apply to base operating circuit 19 and operate invertor 16.

When voltage V3 is set at the maximum output, it is represented as Vcc1*r5/R6+r5 since photocouplers PC1 and PC5 are turn on.

The above explanation is described in connection with burner A, but burner B, C and D are also controlled according to the principle identifying to that of burner A.

What is claimed is:

1. A system for controlling the output of an electronic induction heating cook system, the system comprising;

(1) means for rectifying the AC current of a power source;

(2) an invertor circuit connector to said rectifying means for applying a frequency voltage to at least one heating coil;

(3) an output control means provided with a current feedback/output adjusting circuit and a pulse width modulation circuit, said current feedback-/output adjusting circuit for monitoring a detected current from said power source and for outputting either a first signal if said detected current is more than a predetermined value or a second signal if the detected current is less than said predetermined value, and said pulse width modulation circuit for receiving said first signal or said second signal from said current feedback/output adjusting circuit and for receiving a triangular wave;

(4) a base operating means connected to an output of said output control means, said base operating means for controlling the operation of said invertor circuit according to said output;

(5) a timing circuit connected to said output of said output control means, said timing circuit for generating a pulse cycle having a predetermined time constant;

(6) a wave oscillating circuit for generating said triangular wave corresponding to said pulse cycle of said timing circuit; and (7) an output setting control portion connected to said feedback/output adjusting circuit, said output setting control portion for setting said predetermined value via a selecting key corresponding to a desired heating level for said at least one heating coil, said output setting control portion comprising a microprocessor for generating a predetermined output according to a selection of said selecting key and comprising a decoder connected to said microprocessor for receiving said predetermined output and for optically controlling photocouplers connected in parallel to said decoder in a logical OR configuration, and said photocouplers for adjusting said predetermined value.

2. An output control circuit for an electronic induction heating cook system as claimed in claim 1, wherein:

each of said photocouplers includes a photodiode coupled to a phototransistor, said photodiode having an anode and a cathode, said photodiode connected to said output setting control portion, and said phototransistor connected to said feedback-/output adjusting circuit of said output control means, and said anode of said each of said photocouplers being connected; and said output setting control portion receives a selection signal from said selecting key and applies output setting signals to photodiodes of a selected set of said photocouplers to thereby energize corresponding phototransistors.

3. An output control method for an electronic induction heating cook system comprising a heating coil, a power source for supplying AC current to a rectifying circuit, an inverter circuit connected to the rectifying circuit for applying power to the heating coil, an output control means for generating a detected signal representing the current level supplied by the power source and for controlling the AC current to the heating coil, the output control means including a feedback/output adjusting circuit and a pulse width modulation circuit, a base operating circuit for controlling the inverter circuit based upon the output of the pulse width modulation circuit, a timing circuit connected to the output of the pulse width modulation circuit, the timing circuit for generating a control pulse cycle having a predetermined time constant, an oscillating circuit for generating a triangular wave corresponding to the control pulse cycle, a selecting key corresponding to a desired selection heating level for the heating coil, a microprocessor connected to the selecting key, a decoder connected to the microprocessor and coupled via photocouplers to the feedback/output adjusting circuit, the method comprising the steps of:

(a) generating said detected signal representing the current level supplied by said AC power source;

(b) rectifying said AC current of said AC power source;

(c) applying a frequency voltage to said heating coil via said inverter circuit operating on said AC current;

(d) comparing at said feedback/output adjusting circuit said detected signal against a predetermined value set by said output control means;

(e) outputting from said output control means an output of a low level signal if said detected current is more than said predetermined value, or alternatively, a high level signal if said detected current is less than said predetermined value;

(f) controlling the operation of said invertor circuit using said base operating means responsive to said pulse width modulation circuit;

(g) generating a control pulse cycle having a predetermined time constant using said timing circuit;

(h) generating said triangular wave with said oscillating circuit corresponding to said control pulse cycle of said timing circuit; and (i) generating a pulse width modulation signal with said pulse width modulation circuit from said low level signal or said high level signal and said triangular wave;

(j) selecting said desired selection heating level for said heating coil using said selecting key of said output setting control means;

(k) generating a predetermined output with said microprocessor according to said selection of said selecting key; and (l) said microprocessor controlling optically said feedback/output adjusting circuit via said photocouplers and said decoder, wherein said photocouplers are connected in a logical OR configuration.

* * * * *

UNITED STATES PATENT AND TRADEMARK OFFICE

CERTIFICATE OF CORRECTION

PATENT NO. : 5,010,223

DATED : April 23, 1991

INVENTOR(S) : Jeong Youl KIM

It is certified that error appears in the above-identified patent and that said Letters Patent is hereby corrected as shown below:

Title page, item (73) section entitled "ASSIGNEE", delete "Sang Wook Suh International" and insert -- Sam Sung Electronics Co., Ltd. -- therefor.

Signed and Sealed this

Twenty-ninth Day of September, 1992

*Attest:*

*Attesting Officer*

DOUGLAS B. COMER

*Acting Commissioner of Patents and Trademarks*